US005493960A

United States Patent [19]

Miyao

[11] Patent Number: 5,493,960

[45] Date of Patent: Feb. 27, 1996

[54] DEVICE FOR COLLECTING PAPER CONTAINERS

[75] Inventor: Tetsuya Miyao, Mie, Japan

[73] Assignee: Fuji Electric Co., Ltd., Kawasaki, Japan

[21] Appl. No.: 286,212

[22] Filed: Aug. 5, 1994

[30] Foreign Application Priority Data

Aug. 11, 1993 [JP] Japan ..... 5-198682
Nov. 30, 1993 [JP] Japan ..... 5-299277

[51] Int. Cl.[6] ..... B30B 15/14; B30B 5/06

[52] U.S. Cl. ..... 100/49; 100/152; 100/902

[58] Field of Search ..... 100/49, 151, 152, 100/902

[56] References Cited

U.S. PATENT DOCUMENTS

| | | | |
|---|---|---|---|
| 243,369 | 6/1881 | Gubbins | 100/152 |
| 1,624,703 | 4/1927 | Witte | 100/151 |
| 1,917,659 | 7/1933 | Marshall | 100/151 |
| 2,343,916 | 3/1944 | Long | 100/151 |
| 2,923,439 | 2/1960 | Benton | 100/151 |
| 2,959,364 | 11/1960 | Anderson et al. | 100/151 |
| 3,691,942 | 9/1972 | Wagley | 100/902 |
| 3,821,928 | 7/1974 | Sugita | 100/118 |
| 3,827,351 | 8/1974 | Rosenow | 100/902 |
| 4,995,314 | 2/1991 | Buer | 100/152 |
| 5,355,788 | 10/1994 | Phinney | 100/152 |

FOREIGN PATENT DOCUMENTS

| | | | |
|---|---|---|---|
| 4-228293 | 8/1992 | Japan | 100/902 |

*Primary Examiner*—Stephen F. Gerrity
*Attorney, Agent, or Firm*—Kanesaka & Takeuchi

[57] ABSTRACT

A device for collecting used paper containers is formed of a housing, and a volume reduction mechanism situated in the housing. The volume reduction mechanism squashes the paper containers in a falling passage extending from an inlet port of the housing to thereby reduce the volume of the paper container for efficient collection. The squashed paper container is discharged to a collection box.

5 Claims, 6 Drawing Sheets

DEVICE FOR COLLECTING PAPER CONTAINERS

BACKGROUND OF THE INVENTION AND RELATED ART STATEMENT

The present invention relates to a device for collecting used and empty paper containers, such as cups or packs for beverages from vending machines, while reducing their volume.

In the facilities where many cup beverage or paper-packed beverage (milk or juice) vending machines or green tea dispensers are installed, such as food and beverage stand complexes in tourist resorts or expressway parking areas, many people uses these machines, resulting in forming many empty paper containers, i.e. paper cups or packs. These paper containers are often abandoned and collected in paper container collection boxes or ordinary trash boxes installed in the facilities.

However, such used and empty paper containers have small bulk density, i.e. bulky, and collection or trash boxes are filled quickly with such paper containers. Collection and transport of the paper containers thus require substantial labor, and this makes it difficult to operate trash collection in these facilities.

In view of the above, it is an object of the invention to provide a novel device for collecting paper containers, wherein empty paper containers are compressed to reduce their volume in order to collect the paper containers efficiently.

SUMMARY OF THE INVENTION

In order to achieve the above object, a collection device according to the invention comprises a paper container inlet port integrally disposed in the upper part of a collection box, and a volume reduction mechanism for squashing paper containers in the middle of a falling passage extending from the inlet port and discharging them into the collection box.

The volume reduction mechanism can be made to have the following features:

(1) The volume reduction mechanism comprises a belt press with two belt conveyor mechanisms located opposite to each other in the falling passage to form a large upper space and a narrow lower space between the belt conveyor mechanisms.

(2) In the above mechanism (1), teeth rows in the form of ribbed protrusions are formed on the circumferential faces of the belts of the belt conveyor mechanisms.

(3) In the above mechanisms (1) and (2), the two belt conveyor mechanisms are driven at different rotational speeds, respectively.

(4) In the above mechanisms (1) and (2), at least one of the two belt conveyor mechanisms is wholly supported by a pulley at the inlet side thereof as a supporting point such that the one set of the belt conveyor can be swingable, and a force-applying spring is provided for pulling the one set of the belt conveyor mechanism to the other.

With the above structure, when a used and empty paper cup or pack is thrown into the inlet port, the belt press starts and grips the container between the two belt conveyor mechanisms to squash it to a flat state for reducing the volume. The flattened container is discharged into the collection box. This mechanism substantially improves the accommodating efficiency or receiving capacity of the collection box, and allows many paper containers to be collected in the collection box with a limited volume. This structure is also advantageous when the paper containers collected are transported to a disposal facility.

Since the teeth rows of the ribbed protrusions are formed on the circumferential faces of the belts of the belt conveyor mechanisms, the teeth on the belt faces bite into the paper container to further deform and rimple the flat container to have a wavy pattern. As a result, the paper container is prevented from springing back to its original form.

Since the two belt conveyors are rotated at different speeds, respectively, the middle of the paper container is folded, so that the container can be pressed to a flat state at a small pressure and also the squashed container is prevented from springing back.

Since at least one of the two belt conveyor mechanisms is wholly supported by a pulley at the entry side such that the belt conveyor mechanism can swing, and a force-applying spring is provided for pulling this belt conveyor mechanism to the other, if an empty can different from a paper container in quality is thrown into the device, the empty can pushes the swingable belt conveyor mechanism against the force-applying spring and is discharged. This prevents a hard foreign material, such as an empty can, from sticking in the middle of the passage to lock the volume reduction mechanism resulting in stopping its function.

BRIEF DESCRIPTION OF THE DRAWINGS

FIG. 5(*b*) is an explanatory side view of the main part for showing an operation of the fourth embodiment;

FIG. 5(*c*) is a perspective view of a paper container after compression in the fourth embodiment.

DETAILED DESCRIPTION OF PREFERRED EMBODIMENTS

Embodiments of the invention are described with reference to the drawings.

Figure 1:
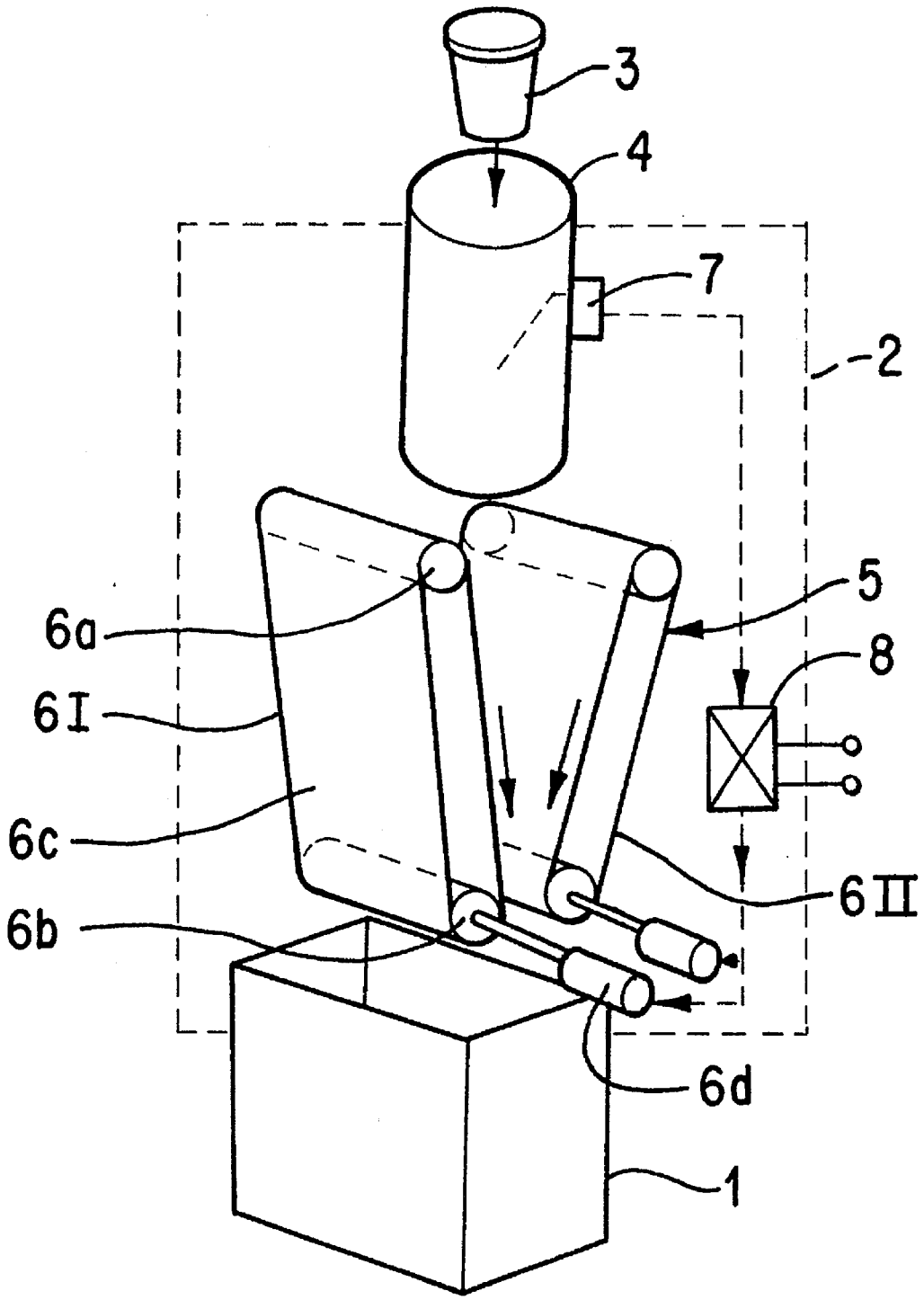
FIG. 1 is a block diagram of a paper container collection device in accordance with a first embodiment of the present invention.

FIG. 1 shows a structure of a first embodiment of the present invention. In this figure, reference numeral 1 is a collection box, such as a trash box, and reference numeral 2 is a paper container volume reduction mechanism integrally provided in the upper part of the collection box 1, which is a main part of the invention.

The volume reduction mechanism 2 has a cylindrical inlet port 4, into which paper containers 3, such as paper cups or packs, are thrown, and a belt press 5 provided below the inlet port 4 and acting as a volume reduction mechanism. The belt press 5 comprises two electric belt conveyor mechanisms 6I, 6II, which are located opposite to each other relative to a falling passage for the paper containers 3 thrown in from the inlet port 4 and are arranged to have a wide upper space and a narrow lower space. Each of the belt conveyor mechanisms 6I, 6II comprises an endless belt 6C extending between upper and lower pulleys **6*a*, 6*b* and rotated by a drive motor 6*d***.

Reference numeral 7 is a paper container detection switch provided in the inlet port 4, and reference numeral 8 is an operation control section for the belt press 5.

Figure 2A:
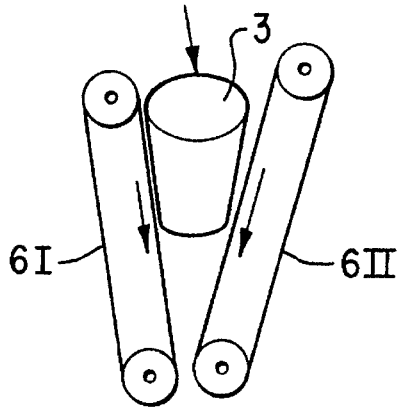
FIGS. 2(*a*), 2(*b*) and 2(*c*) are explanatory side views illustrating a compression operation from receiving to discharging of a paper container in the first embodiment.
Figure 2B:
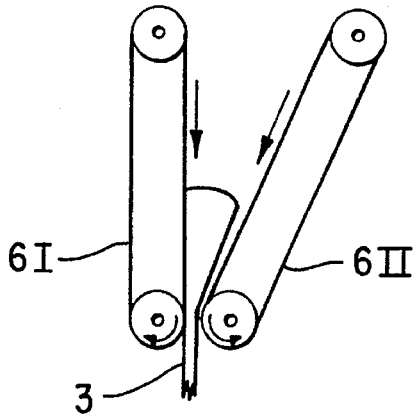
Figure 2C:
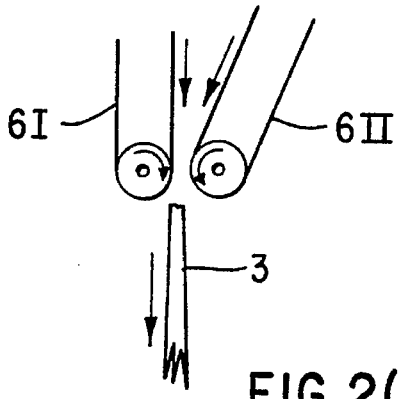

The paper container collection operation by the structure in FIG. 1 is described with reference to FIGS. 2 (*a*) to 2(*c*). In the standby state, the belt conveyor mechanisms 6I, 6II of the belt press 5 are stopped. When a paper container 3 is thrown into the inlet port 4, the drive motor **6*d* for the belt conveyor mechanisms 6I, 6II starts based upon a detection signal from the switch 7 to rotationally drive the left side belt conveyor mechanism 6I in the clockwise direction and the right side belt conveyor mechanism 6II** in the counterclockwise direction in synchronous with each other.

This causes the paper container 3 falling from the inlet port 4 to be gripped by the belt conveyors 6I, 6II and transported downwardly. Since the passage between the belt conveyors 6I, 6II is tapered toward the exit side like a wedge, the paper container is compressed in the middle of the transfer, as shown in FIG. 2(*b*), and is squashed to a flat state to lose its volume. The compressed container is discharged into the collection box 1 (see FIG. 1), as shown in FIG. 2(*c*).

Figure 3A:
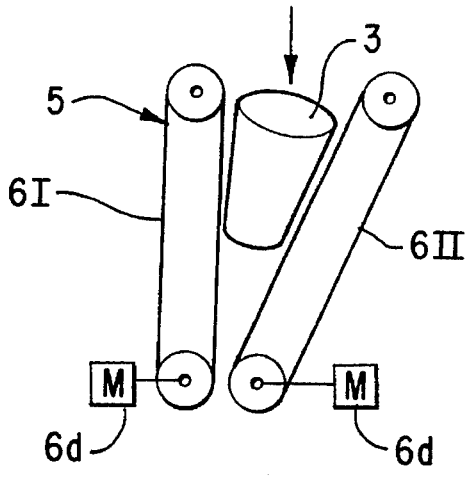
FIGS. 3(*a*), 3(*b*) and 3(*c*) are explanatory side views of a main part of a second embodiment, illustrating a compression operation from receiving to discharging of a paper container.
Figure 3B:
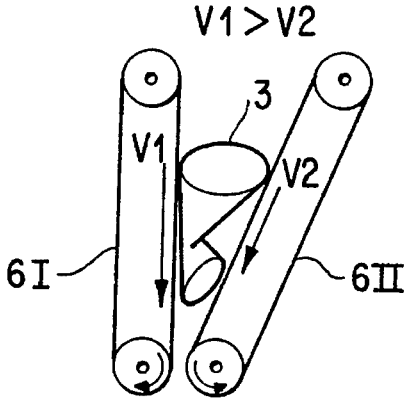
Figure 3C:
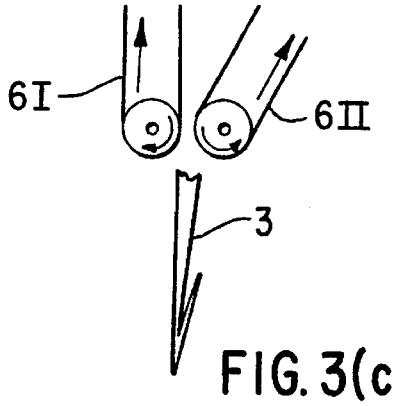

FIGS. 3(*a*) to 3(*c*) describe the operation of a second embodiment of the present invention. In the above first embodiment, in case the two belt conveyor mechanisms 6I, 6II are rotated synchronously at the same speed, when the paper container 3 is discharged into the collection box 1 after being squashed to a flat state, the container 3 may spring back closely to its original form. In particular, if the bottom of a cup is squashed to an irregular shape, it easily springs back to the original shape.

In the second embodiment, the two belt conveyor mechanisms 6I, 6II are driven to rotate by the motor **6*d* at different rotational speeds V1 and V2. For example, the rate of V1 to V2 is set to 2:1. This causes, when the container 3 is shifting from FIG. 3**(*a*) to FIG. 3(*b*), shearing force to the paper container 3 due to the difference in speed of the belt to thereby fold the middle of the paper container, as shown in FIG. 3(*b*). The paper container 3 exiting from the belt press 5 has a predetermined shape with its bottom folded over its middle, and is discharged into the collection box. This prevents the squashed paper container 3 from springing back to its original shape to improve the accommodating efficiency of the collection box.

Figure 4:
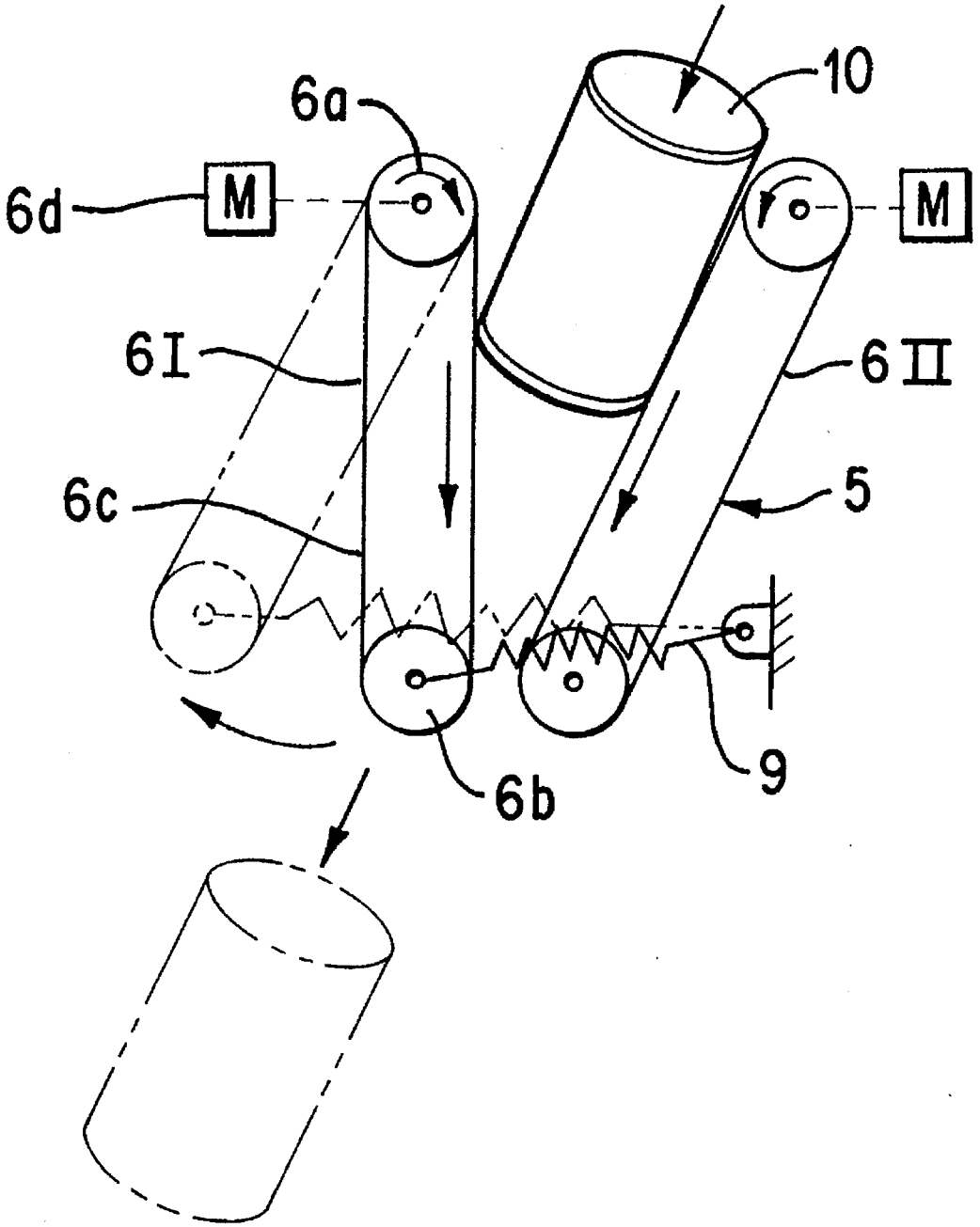
FIG. 4 shows an explanatory side view for showing a structure and operation of a main part of a paper container collection device of a third embodiment of the invention.

FIG. 4 shows a third embodiment of the invention. That is, in the above embodiments, when an empty can different from the paper container 3 in quality is thrown into the inlet port, the empty can may stick in the belt press 5 without being squashed to thereby lock the belt conveyor mechanism 6. Accordingly, the compression function is stopped to cause a failure.

In the embodiment, one mechanism 6I of the belt conveyor mechanisms 6I, 6II is wholly supported by a pulley **6*a* at the entry (upper) side as a supporting point such that the mechanism 6I can swing right and left directions. A force-applying spring 9 for pulling the exit end of the belt conveyor 6I toward the belt conveyor mechanism 6II is fixed to a pulley 6*b*** on the exit (lower) side.

With this structure, if a foreign material, such as an empty can 10, is thrown from the inlet port (see FIG. 1), it is transported between the right and left belt conveyor mechanisms 6I and 6II of the belt press 5 without being squashed, while pushing the left side belt conveyor mechanism 6I from a solid line position to a chain line position against the force-applying spring 9. The foreign material is then discharged downwardly. This mechanism safely prevents the empty can 10 from sticking in the passage of the belt press 5 to lock the belt conveyor mechanisms 6I, 6II resulting to stop the function.

Figure 5A:
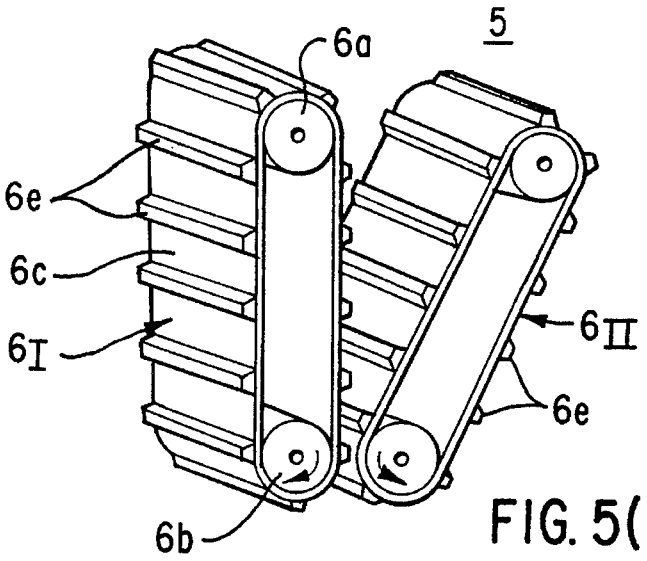
FIG. 5(*a*) is a perspective view of a main part of a fourth embodiment of a paper container collection device.
Figure 5B:
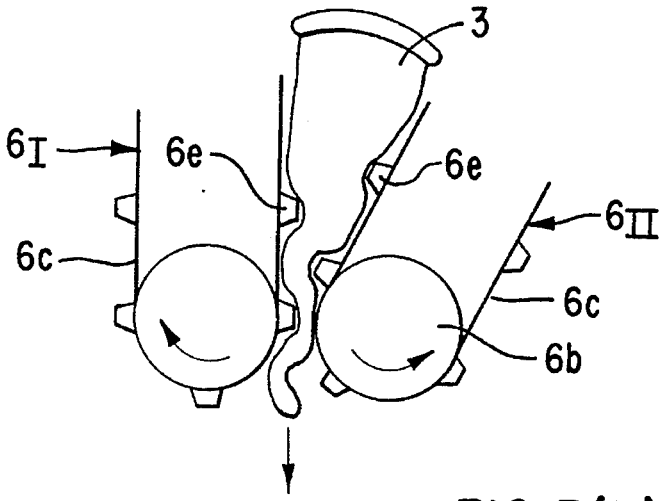
Figure 5C:
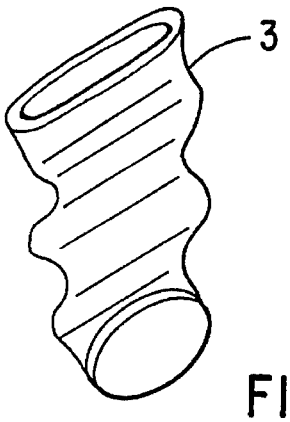

FIGS. 5(*a*) to 5(*c*) shows a fourth embodiment of the invention to improve the belt press described in the previous embodiments. In this embodiment, teeth **6*e* of ribbed protrusions are formed at a specified interval on the outer circumferential surfaces of the belts 6*c* of the belt conveyor mechanisms 6I, 6II. The belt conveyor mechanisms 6I, 6II are operated synchronously so that the teeth 6*e*** of the two conveyors engage with each other with a discrepancy of a half pitch maintained.

With this structure, the teeth **6*e* bite the paper container 3 during the paper container 3 squashing process shown in FIG. 5**(*b*). As a result, the paper container discharged from the belt press 5 is squashed to a flat state and also rimpled to have a wavy pattern as shown in FIG. 5(*c*). Therefore, the paper container 3 is reliably prevented from spring back to its original form. The results of actual tests show that the volume reduction effect of this embodiment is improved to about 1 and a half relative to the first embodiment.

In addition, if, in this embodiment, the two belt conveyor mechanisms 6I, 6II are rotated at different rotational speeds as described in the second embodiment, the spring-back preventing function can be further improved because the rimpling of the paper container by the teeth **6*e* is enhanced by the difference in the rotational speed of the conveyor mechanisms. Of course, the toothed belt conveyor mechanisms can be used for the structure described in the third embodiment (FIG. 4**).

Figure 6:
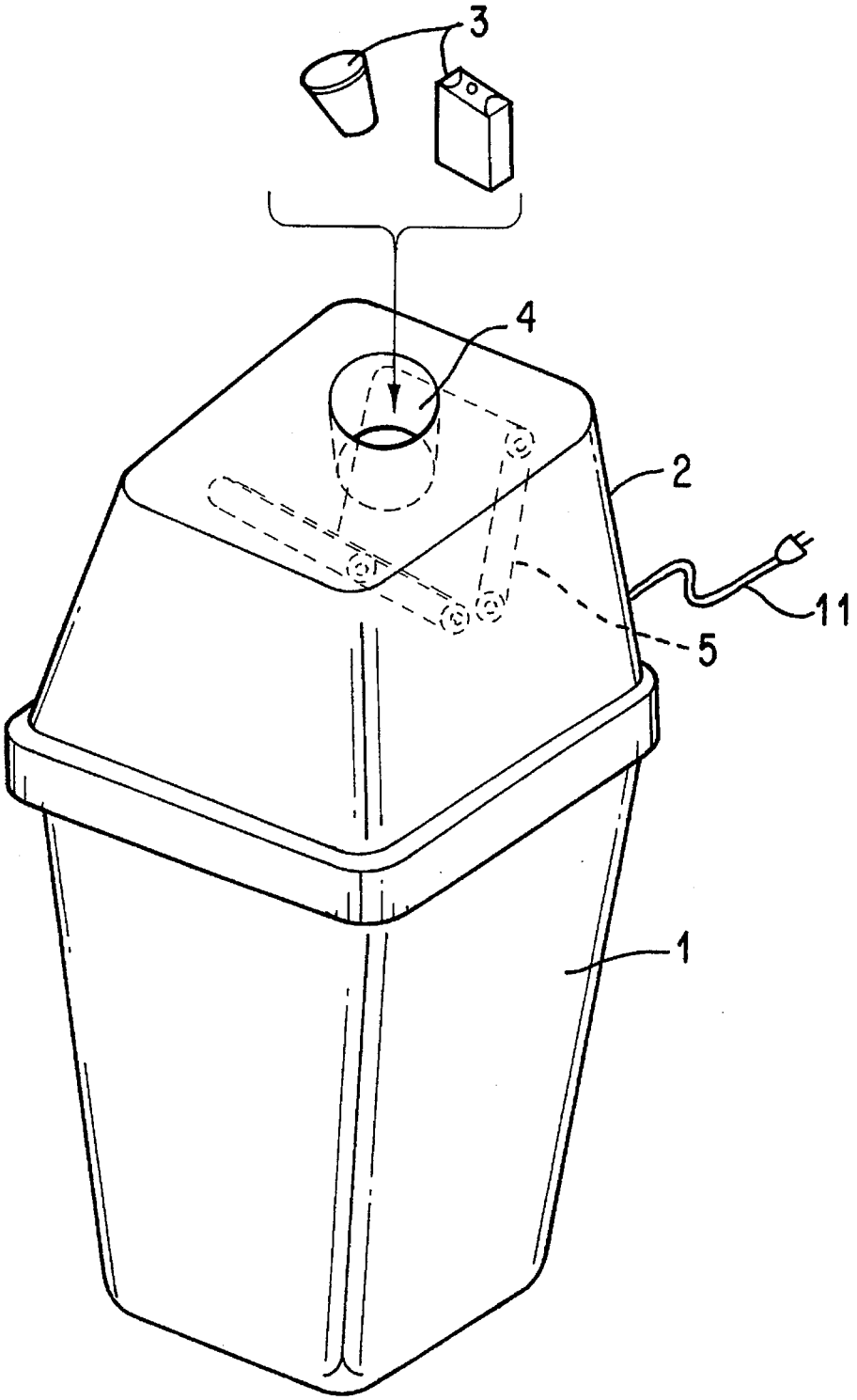
FIG. 6 is a perspective view of the overall paper container collection device in accordance with the present invention.

The paper container collection device in accordance with the invention can not only be used as a paper container collection device with the volume reduction mechanism 2 incorporated into the collection box 1, but also be used as a simple collection device including an existing trash collection box in the facility, the cover of which is replaced with the volume reduction mechanism 2 with the belt press 5 incorporated therein. Reference numeral 11 in FIG. 6 is an electric power code.

According to the invention, when collecting many used and empty paper containers, such as paper cups or packs, from the vending machines stand complexes in the tourist resorts or expressway parking areas, a combination of the collection box and the volume reduction mechanism allows the paper containers thrown in the inlet port to be compressed to reduce the volume before being collected in the collection box. This substantially improves the accommodating efficiency compared with the conventional method, wherein the paper containers are abandoned in the collection boxes or trash boxes without compression. This also substantially improves the trash collection operations in the above facilities which have been a problem.

What is claimed is:

1. A device for collecting used paper containers comprising:

a housing having an inlet port integrally disposed in an upper part of the housing to receive the paper containers, and a falling passage communicating with the inlet port to allow the paper containers to pass therethrough, and a volume reduction mechanism situated in the housing, said volume reduction mechanism squashing the paper containers in the falling passage and discharging the paper containers therefrom, said volume reduction mechanism being a belt press with two belt conveyor mechanisms located opposite to each other with respect to the falling passage, said belt conveyor mechanisms being arranged to have a wide space near the inlet port and a narrow space at a side opposite to the wide space, each belt conveyor mechanism including upper and lower pulleys, and an endless belt between the two pulleys and rotated by one of the pulleys, at least one of the two belt conveyor mechanisms being wholly supported by the upper pulley thereof so that the lower pulley and the endless belt of the belt conveyor mechanism can swing relative to the upper pulley to form a swingable belt conveyor mechanism, said swingable belt conveyor mechanism supported by the upper pulley having a spring for urging the lower pulley of the swingable belt conveyor mechanism to the lower pulley of the other belt conveyor mechanism so that when the paper container enters between the belt conveyor mechanisms, the paper container is squashed by the belt conveyor mechanisms, and when a hard material harder than a predetermined value and having a size larger than the narrow space enters between the belt conveyor mechanisms, the lower pulley of the swingable belt conveyor mechanism is urged away from the other lower pulley to thereby allow the hard material to pass between the lower pulleys without crushing.

2. A device according to claim 1, wherein said two belt conveyor mechanisms are driven at different rotational speeds, respectively.

3. A device according to claim 1, further comprising a collection box disposed under the housing to collect the squashed paper containers.

4. A device according to claim 3, wherein said housing has a switch for detecting the paper container thrown into the housing through the inlet port, said switch triggering operation of the volume reduction mechanism.

5. A device according to claim 1, wherein said lower pulley of the swingable belt conveyor mechanism is movable away from the other lower pulley such that the endless belts of the two belt conveyor mechanisms become substantially parallel to each other.

* * * * *